United States Patent [19]

Amici et al.

[11] Patent Number: 4,887,820

[45] Date of Patent: Dec. 19, 1989

[54] VACUUM BALL HOLDING DEVICE

[75] Inventors: Francis R. Amici, Northford, Conn.; Brian Fontaine, Southbridge, Mass.

[73] Assignee: Coleco Industries, Inc., Avon, Conn.

[21] Appl. No.: 332,691

[22] Filed: Apr. 3, 1989

[51] Int. Cl.[4] ..... A63B 65/12

[52] U.S. Cl. ..... 273/323; 273/344; 273/DIG. 25

[58] Field of Search ..... 273/323, 324, 344, 64, 273/DIG. 25

[56] References Cited

U.S. PATENT DOCUMENTS

| | | | |
|---|---|---|---|
| 1,210,847 | 1/1917 | Rubel | 273/324 |
| 1,918,718 | 7/1933 | Samsel | 273/344 |
| 2,042,544 | 6/1936 | McCrea | 273/324 |
| 2,771,294 | 11/1956 | MacChesney | 273/344 X |
| 3,141,173 | 7/1964 | Jackson et al. | 273/344 X |
| 3,655,193 | 4/1972 | Jones | 273/DIG. 25 |
| 3,765,677 | 11/1973 | Carver | 273/323 |
| 4,017,076 | 4/1977 | Bai | 273/344 X |
| 4,360,206 | 11/1982 | Bian | 273/DIG. 25 X |

FOREIGN PATENT DOCUMENTS

| | | |
|---|---|---|
| 1434002 | 2/1966 | France . |
| 1056947 | 2/1967 | United Kingdom . |

*Primary Examiner*—William H. Grieb

[57] ABSTRACT

A ball holding device has an elongated handle having a cavity opening at one end thereof and a passage opening to the side thereof spaced from its one end. Seated in the cavity is an elastomeric vacuum cup which has a body portion disposed in the cavity with a conduit portion extending outwardly of the passage. The cup has a passage extending from a spherical recess of the vacuum cup through the body portion and then through the conduit portion to the exterior of the handle so that a user may open or close the passage by movement of the thumb. The handle includes internal ribs which support and engage the body portion of the vacuum cup to provide firm support and engagement therefor.

12 Claims, 2 Drawing Sheets

VACUUM BALL HOLDING DEVICE

BACKGROUND OF THE INVENTION

The present invention related to ball holding devices utilized for catching and holding a ball during play action by means of a vacuum controlled by the user's thumb.

In Carver U.S. Pat. No. 3,765,677, there is illustrated and described a vacuum ball holding device which has enjoyed considerable commercial success. The user grips the handle in one hand with the thumb disposed adjacent an opening in the handle so that their thumb may effect sealing of an air passage leading from a vacuum cup at the end of the handle in which the ball is caught. Although such devices have proven highly popular, there has remained a need to produce similar devices which would provide greater comfort to the user, better vacuum sealing action and less tendency for the suction cup to move relative to the handle and release the ball, particularly when the ball has been thrown rapidly.

It is also an object to provide such a ball holding device in which the sealing action may be readily and comfortably effected.

Another object is to provide such a ball holding device which may be readily and economically fabricated and assembled.

SUMMARY OF THE INVENTION

It has now been found that the foregoing and related objects and advantages may be readily attained in a ball catching and holding device which has an elongated handle formed of a pair of sections mating along the longitudinal axis thereof and means securing the sections in assembly. The handle has a cavity opening at one end thereof, and the sidewalls of the sections defining the cavity provide inwardly extending ribs and define a passage opening on the side of the handle adjacent its one end.

A vacuum cup is integrally formed of a resiliently deformable elastomer and has a body portion seated in the handle cavity. The cup has a relatively wide holder portion disposed outwardly of the cavity, and it defines a generally spherical recess at the outer end thereof. The body portion has a conduit portion extending to one side thereof and outwardly of the passage in the handle. The cup has a passage extending coaxially from the spherical cavity to the conduit portion and thence through the conduit portion to open at the end thereof outwardly of the handle. The ribs on the handle engage and support the body portion of the cup to retain the cup securely in the handle.

Preferably, the body portion of the cup has recesses in its periphery in which ribs on the handle are seated. The handle also has a transversely extending wall portion in the cavity against which abuts the inner end of the body portion of the cup.

Desirably, the handle is generally curvilinear along its axis perpendicular to the conduit, and it has finger receiving recesses along its length. In its preferred construction, the handle is a relatively rigid member with a resiliently deformable covering over at least a portion of its length.

Most desirably, the conduit portion of the cup projects substantially outwardly of the handle to facilitate sealing by the user's thumb. The handle has an opening therein at the end spaced from the cup, and the device includes a lanyard extending through the opening in the end of the handle and anchored in the handle.

DETAILED DESCRIPTION OF THE ILLUSTRATED EMBODIMENT

Turning now in detail to the attached drawings, the ball holding device of the present invention is generally comprised of an elongated handle generally designated by the numeral 10 and a suction cup generally designated by the numeral 12.

Figure 1:
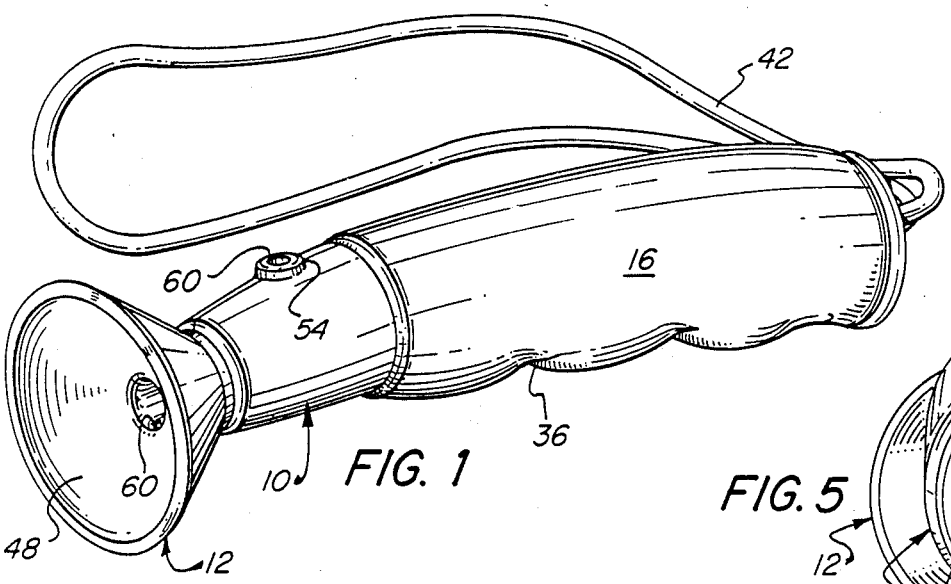
FIG. 1 is a perspective view of a ball holding device embodying the present invention.
Figure 5:
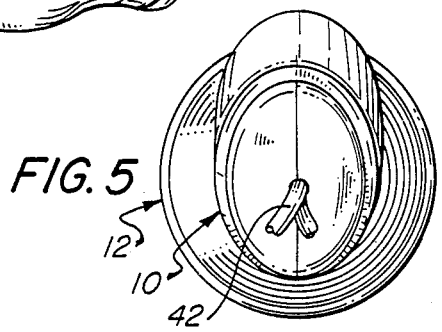
FIG. 5 is an end elevational view thereof.
Figure 2:
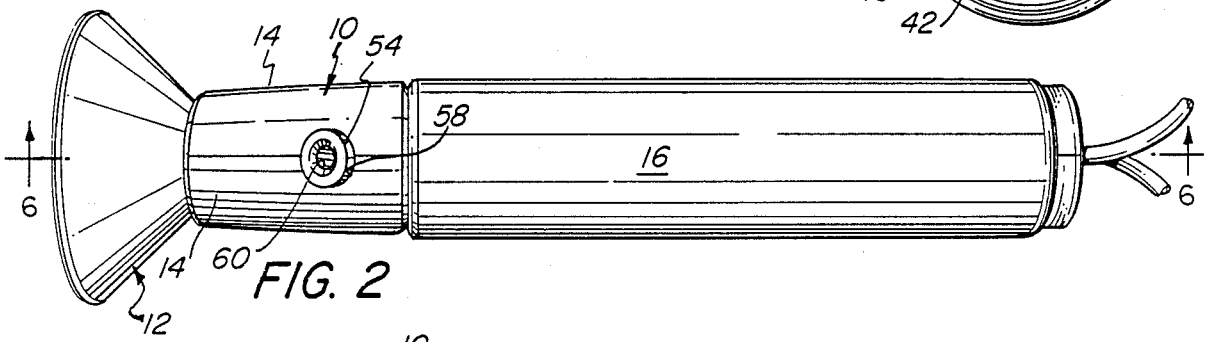
FIG. 2 is a top plan view thereof with the lanyard fragmentarily illustrated.
Figure 3:
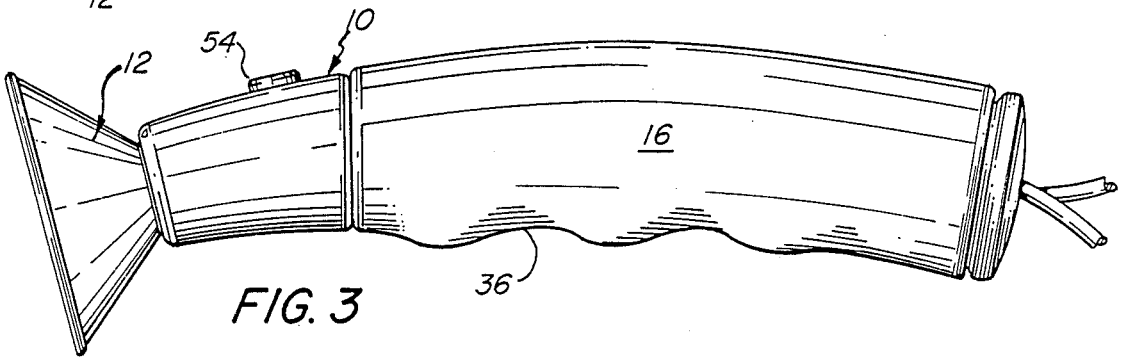
FIG. 3 is a side elevational view thereof.
Figure 4:
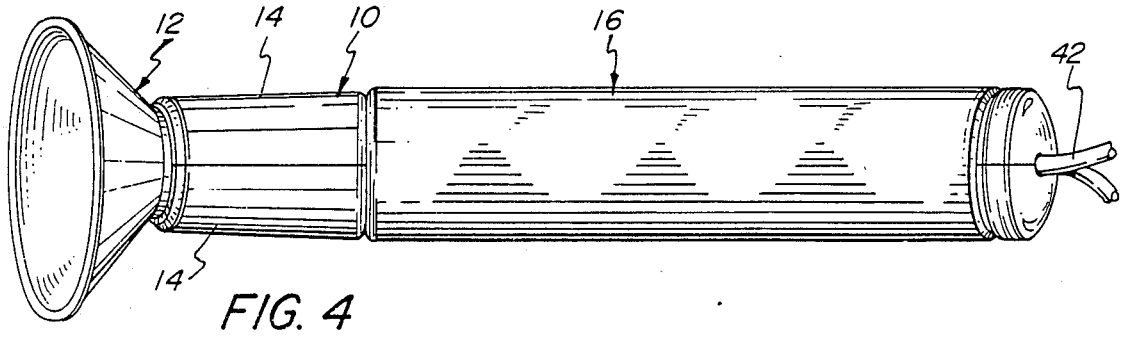
FIG. 4 is a botton view thereof.
Figure 6:
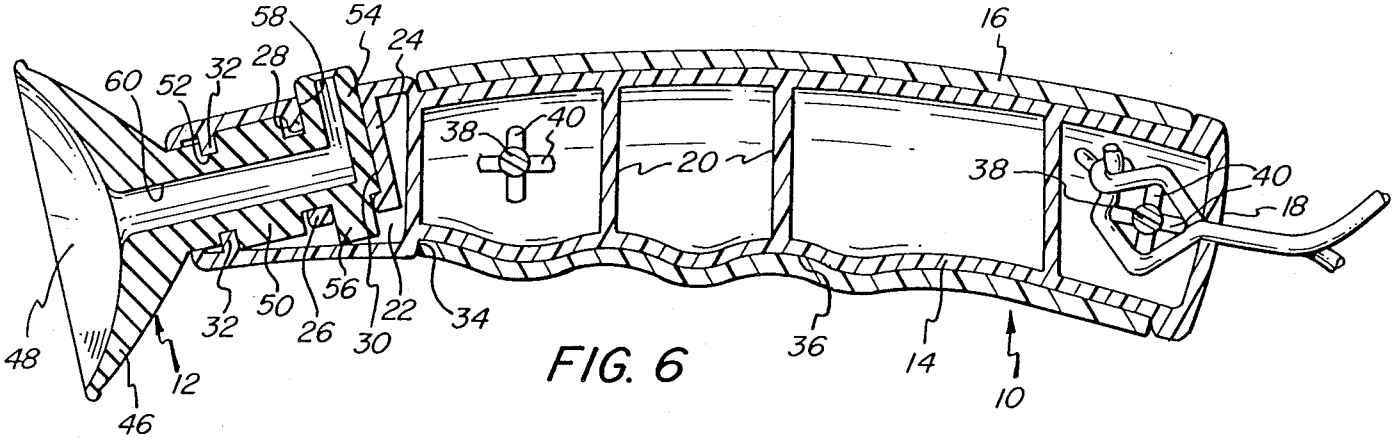
FIG. 6 is a longitudinal sectional view along the line 6—6 of FIG. 2.
Figure 7:
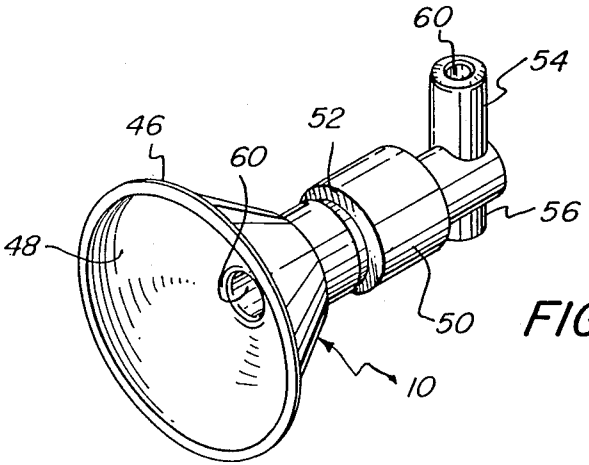
FIG. 7 is a perspective view of the cup component.

The handle 10 itself is comprised of a pair of elongated sections 14 which are adhesively bonded along their mating surfaces, and a sleeve 16 of resiliently compressible material which extends over the major portion of the length thereof. As best seen in FIG. 6, the sections 14 are generally hollow with an end wall 18, a series of transversely extending walls 20 to reinforce the handle 10, and a cavity 22 at the opening at the opposite end thereof.

Adjacent the inner end of the cavity 22 in each section 14 are an angularly disposed wall 24 and inwardly extending ribs 26,28 which define a pocket 30 which seats the inner end of the suction cup 12. Adjacent the outer end of the cavity 22 are inwardly extending ribs 32.

The handle sections 14 are molded with a recessed portion 34 in which is seated the sleeve 16. The sections 14 are also formed with a sinuous surface portion 36 along the lower surface of the recessed portion 34 to seat comfortably the fingers of the user, and the sleeve 16 closely follows its sinuous contour.

On the inner surface of one section 14 are posts 38 and reinforcing ribs 40 thereabout, and the inner surface of the other section 14 has cylindrical bosses (not shown) which seat the posts 38 to locate the two sections in desired alignment. Looped about the rearward post 38 is the lanyard 42 which extends through an aperture 44 in the end wall 18.

Turning now to the suction cup 12, its outer end 46 is relatively wide and cup-shaped and defines a generally spherical recess 48. It also has an elongated body 50 seated within the cavity 22 and providing a recess 52 in which are disposed the ribs 32. Adjacent the inner end of the body 50 is a transversely extending conduit portion 54 of generally cylindrical cross section and an oppositely extending boss 56 of circular cross section. The conduit portion 54 and boss 56 seat in the pocket 30, and the conduit portion 54 extends outwardly through an aperture 58 in the handle 10. A conduit 60 extends coaxially from the spherical recess 48 through the body 50, and thence through the conduit portion 54 to open outwardly of the handle 10.

The handle sections 14 are conveniently molded from synthetic resins such as high impact polystyrene, acrylonitrile/butadiene/styrene (ABS) interpolymers, polyethylene, polycarbonate, etc., to provide a relatively rugged structure which may be readily assembled.

The cup 12 is conveniently molded from a durable elastomeric resin such as butadiene/styrene, butadiene/acrylonitrile and neoprene, having a durometer of about 40–50 on the Shure A scale.

The sleeve is conveniently an extruded tubular element formed of a resiliently compressible resin such as a polyurethane foam. The lanyard may be fabricated from leather, braided cord, or the like.

In assembling the several elements, the cup 12 and lanyard 42 are placed in one of the sections 14 and then the other section is assembled thereon with the posts 38 and cooperating bosses (not shown) serving to effect proper alignment. The two sections 14 are then adhesively bonded, conveniently by sonic welding although separate adhesives and solvent bonding may also be employed. Finally the tubular sleeve is stretched and slipped over the handle until seated in the recess.

Desirably a small amount of adhesive may be provided at spaced points on the handle to bond the sleeve thereto, and eliminate any tendency for it to slide thereon.

During play use of the ball holding device, the user grips the handle securely in one hand and disposes the thumb adjacent the outwardly extending conduit portion. When the ball is thrown, the user attempts to catch it on the end of the suction cup and simultaneously close the conduit portion with his thumb to produce a vacuum. This will retain the ball in the cup until the thumb is removed to allow air to break the vacuum holding the ball within the cup.

To throw the ball, the user may perform an underhand or overhand motion and remove the thumb from the conduit portion at the end of the swing so that the ball will be released and travel in the desired direction. In game play, two or more persons utilizing the catching devices of the present invention can rapidly pass the ball among themselves and the skill of the players in catching the ball, retaining it and throwing it will provide highly desirable play action.

Because the suction cup is integrally formed with a body portion which is securely seated within the handle, the cup is stably positioned. The force of the ball striking the cup is in part transmitted to the handle through the transverse wall of the pocket.

Thus, it can be seen from the foregoing detailed specification and attached drawings that the ball catching device of the present invention enables facile catching and holding of a ball on the end thereof, and then releasing of it during a throwing action. The handle provides a convenient grip and the user's thumb may readily seal the air passage to create the vacuum for holding the ball. The parts may be readily and economically fabricated and assembled to provide a relatively long lived device.

Having thus described the invention, what is claimed is:

1. A ball catching and holding device comprising:

(a) an elongated handle formed of a pair of sections mating along the longitudinal axis thereof and means securing said sections in assembly, said handle having a cavity opening at one end thereof, the sidewalls of said sections defining said cavity providing inwardly extending ribs and defining a passage opening on the side of said handle adjacent said one end; and (b) a vacuum cup integrally formed of a resiliently deformable elastomer, said cup having a body portion seated in said handle cavity and a relatively wide holder portion disposed outwardly of said cavity and defining a generally spherical recess at the outer end thereof, said body portion having a conduit portion extending to one side thereof and outwardly of said passage in said handle, said cup having a passage extending coaxially from said spherical cavity to said conduit portion and thence through said conduit portion to open at the end thereof outwardly of said handle, said ribs engaging and supporting said body portion to retain said cup securely in said handle.

2. The device of claim 1 wherein said body portion of said cup has recesses in its periphery in which said ribs are seated.

3. The device of claim 1 wherein said handle is generally curvilinear along its axis perpendicular to said conduit portion.

4. The device of claim 3 wherein said handle has finger receiving recesses along the length thereof.

5. The device of claim 1 wherein said handle is a relatively rigid member with a resiliently deformable covering over at least a portion of the length thereof.

6. The device of claim 1 wherein said conduit portion of said cup projects outwardly of said handle to facilitate sealing by the user's thumb.

7. The device of claim 1 wherein said handle has an opening therein at the end thereof spaced from said cup and a lanyard extends through said opening and is anchored in said handle.

8. The device of claim 1 wherein said handle has a transversely extending wall portion in said cavity against which abuts the inner end of said body portion of said cup.

9. A ball catching and holding device comprising:

(a) an elongated handle formed of a pair of sections mating along the longitudinal axis thereof and means securing said sections in assembly, said handle having a cavity opening at one end thereof, the sidewalls of said sections defining said cavity providing inwardly extending ribs and defining a passage opening on the side of said handle adjacent said one end; and (b) a vacuum cup integrally formed of a resiliently deformable elastomer, said cup having a body portion seated in said handle cavity and a relatively wide holder portion disposed outwardly of said cavity and defining a generally spherical recess at the outer end thereof, said body portion having a conduit portion extending to one side thereof and outwardly of said passage in said handle, said cup having a passage extending coaxially from said spherical cavity to said conduit portion and thence through said conduit portion to open at the end thereof outwardly of said handle, said conduit portion of said cup projecting outwardly of said handle a sufficient distance to facilitate comfortable sealing by the user's thumb, said ribs engaging and supporting said body portion to retain said cup securely in said handle, said handle having a transversely extending wall portion in said cavity against which abuts the inner end of said body portion of said cup.

10. The device of claim 9 wherein said handle is generally curvilinear along its axis perpendicular to said conduit portion and has finger receiving recesses along the length thereof.

11. The device of claim 10 wherein said handle is a relatively rigid member with a resiliently deformable covering over at least a portion of the length thereof.

12. The device of claim 9 wherein said handle has an opening therein at the end thereof spaced from said cup and a lanyard extends through said opening and is anchored in said handle.

* * * * *